United States Patent [19]

Gotfryd et al.

[11] Patent Number: 4,859,820

[45] Date of Patent: Aug. 22, 1989

[54] QUIET KEY SWITCH

[75] Inventors: Casimer Gotfryd, Wauconda; Stephen L. Kay, Palatine; Hartland P. Klotz, Highland Park; Robert M. Wentzel, Mundelein, all of Ill.

[73] Assignees: American Telephone and Telegraph Company, New York, N.Y.; AT&T Information Systems Inc., Morristown, N.J.

[21] Appl. No.: 175,974

[22] Filed: Mar. 31, 1988

[51] Int. Cl.[4] ..... H01H 13/14

[52] U.S. Cl. ..... 200/408; 200/341; 200/457; 200/517; 200/521

[58] Field of Search ..... 200/67 A, 340, 521, 200/341, 408, 457, 517; 267/166, 167

[56] References Cited

U.S. PATENT DOCUMENTS

| | | | |
|---|---|---|---|
| 2,832,587 | 4/1958 | Robert | 267/286 |
| 4,011,397 | 3/1977 | Bouche | 267/167 |
| 4,118,611 | 10/1978 | Harris | 200/408 |
| 4,528,431 | 7/1985 | Coleman, III | 200/408 |
| 4,633,973 | 1/1987 | Kitano | 267/33 |
| 4,753,423 | 6/1988 | Ukai et al. | 267/167 |

*Primary Examiner*—Renee S. Luebke
*Attorney, Agent, or Firm*—A. A. Tirva

[57] ABSTRACT

A key switch utilizing a buckling compression spring to move a switch actuator mechanism includes a cylindrical core of resilient material located within an opening formed by the coils of the compression spring to attenuate the acoustical energy generated by the buckling and unbuckling action of the spring.

6 Claims, 2 Drawing Sheets

FIG. 3
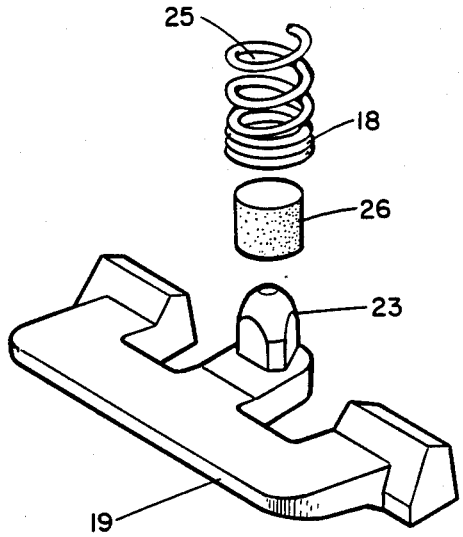
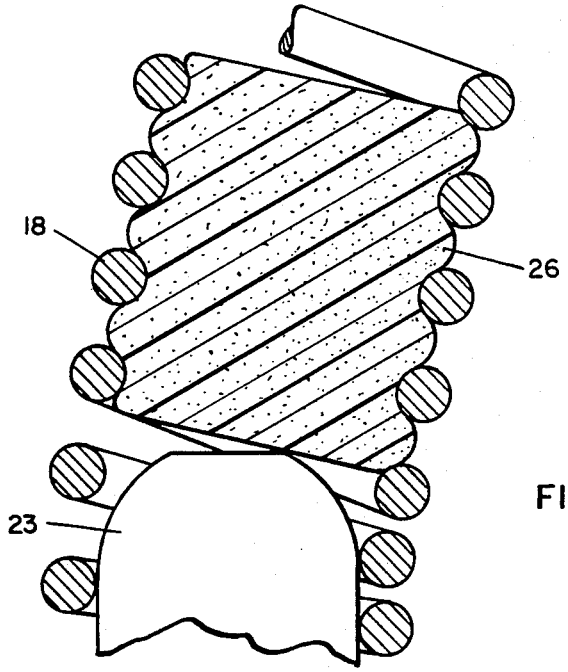
FIG. 4

QUIET KEY SWITCH

TECHNICAL FIELD

The invention relates to key switch mechanisms used in keyboards and more particularly to the damping of acoustical noise generated by such key switch mechanisms.

BACKGROUND OF THE INVENTION

Key switch mechanisms utilizing buckling compression springs to move a switch actuator in response to the depression of a key are well known in the art and are described in U.S. Pat. No. 4,118,611 to R. H. Harris and U.S. Pat. No. 4,528,431 to E. T. Coleman.

Use of the buckling compression spring enables construction of a low cost key switch mechanism wherein the buckling spring is used to move the switch actuator in response to a force exerted upon a key to depress the key, and wherein the spring restores the key back to the normal position once the downward force is removed from the key. The buckling spring in operating the switch mechanism generates a substantial amount of acoustical noise which grows in intensity and volume almost directly proportional to the speed of the typing by a keyboard operator. Many keyboard operators find the noise irritating and tiring. The noise may disrupt an operator's concentration and may lead to typing errors.

The present invention is an improvement of the key switch mechanism of the aforesaid Harris and Coleman patents in that the acoustical ringing noise generates by the buckling spring is dampened to a point so as not to interfere and disrupt the keyboard operator's concentration.

SUMMARY OF THE INVENTION

In accordance with the present invention, acoustical noise generated by the buckling coil spring in a key switch mechanism is minimized by insertion into an opening formed by the coils of the spring, a cylindrical core formed from a foam type material and positioning it in a predetermined location within the opening in the spring.

BRIEF DESCRIPTION OF THE DRAWING

FIG. 3 is a partial enlarged, exploded view of the actuator before assembly.

FIG. 4 is similar to FIG. 3 showing the actuator after assembly.

DETAILED DESCRIPTION

Figure 1:
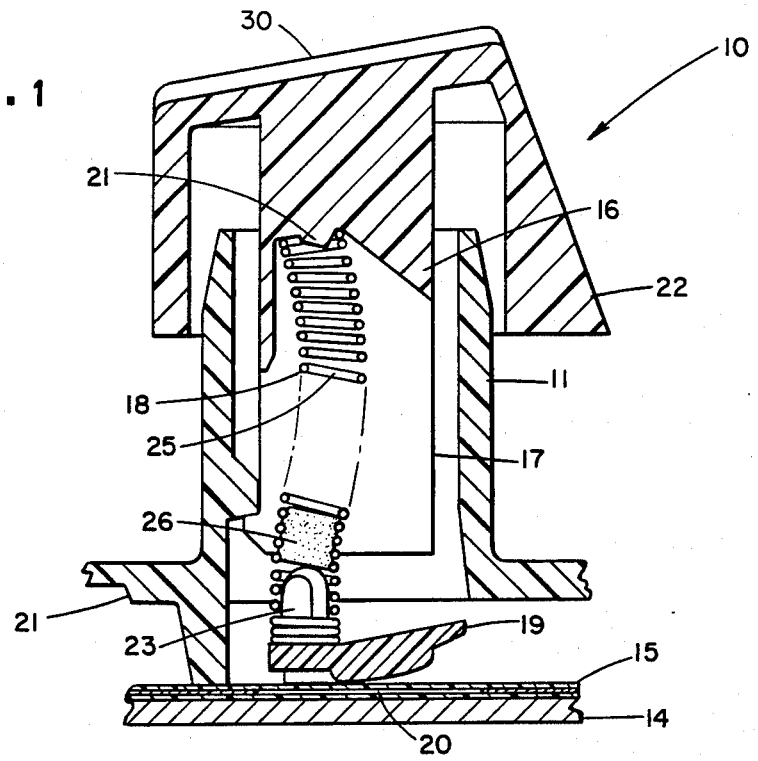
FIG. 1 is a sectional view of a key switch in its rest position showing a key cap, a switch actuator and a buckling coil spring with a cylindrical core of damping material.

Referring to the accompanying drawing and more particularly to FIG. 1, there is shown a key switch 10 of a keyboard (not shown) which may be used with a personal computer, teleprinter or the like to select one of the characters of the keyboard.

The key switch 10 has a key top or key button 30 which is slidably movable on a hollow cylindrical support 11 of a frame 12. The frame 12 is attached to a metal base 14 which is supported by the keyboard frame (not shown). A membrane contact switch assembly 15 rests on the upper surface of the base 14.

The key top 30 includes a downwardly extending stem 16 extending inside of the upstanding hollow cylindrical support 11 of the frame 12 and being slidably supported thereby. The exterior of the stem 16, which is bifurcated to have two separate skirts 17 (one shown), and the interior of the upstanding hollow cylindrical support 11 have cooperating ribs and slots to orient the key top 30 and to guide it during its vertical motion when it is depressed by a user and then released.

Figure 2:
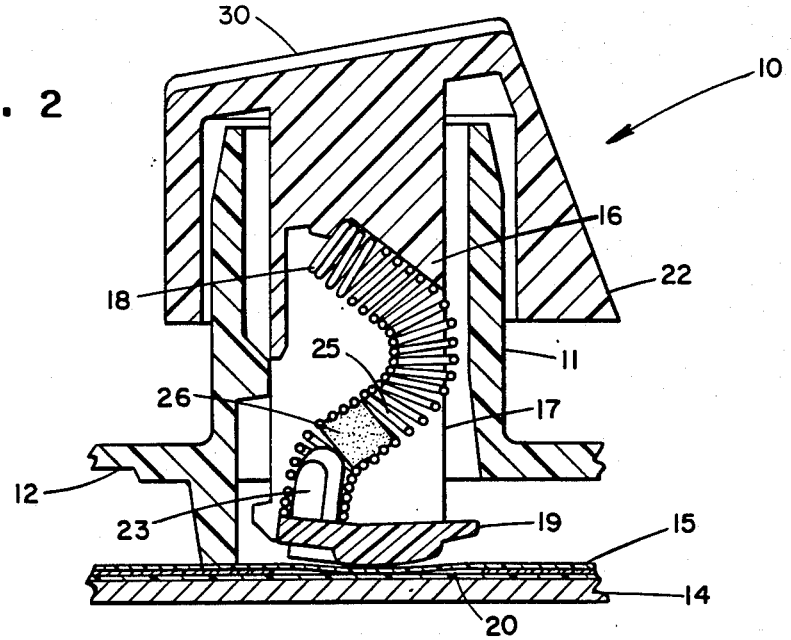
FIG. 2 is similar to FIG. 1 but showing the key switch in its actuated position.

A spring 18 extends between the key top 30 and a pivoting rocking actuator 19, which causes closure of a contact switch 20 of the membrane contact switch assembly 15 when the key top 30 is depressed. The spring 18 has its upper end acting against a mounting base 21 in the stem 16 of the key top 30. The mounting base 21 is angled slightly to set the initial deflection of the spring 18 in a selected direction (to the right in FIG. 2). This is towards the back of the keyboard as an inclined surface 22 of the key top 30 is the front surface of the key top 30. Any sideways buckling of the spring 18 is limited by the skirts 17 of the stem 16 of the key top 30.

The spring 18 has its lower end surround an upstanding post 23 of the pivoting rocking actuator 19 and is attached thereto by a press fit. When the key top 30 is depressed from the position of the FIG. 1 to position of FIG. 2, the force exerted on the key top 30 is transmitted by spring 18 to the actuator 19. At the same time, during the depression of the key top 30, the spring 18 undergoes a catastrophic buckling causing the actuator 19 to pivot about its axis. When the key top 30 is released, the spring 18 unbuckles restoring the key top 30 to its normal position. The catastrophic buckling and unbuckling of the spring 18 generates acoustical noise which can be best described as having two components. The first component is a metallic "click" and the second is a decaying metallic "ring".

It has been experimentally determined that inserting a cylindrical core 26 made of foam material such as closed cell urethane within an opening 25 formed by coils of the spring 18 and positioning the core 26 just above the post 23 attenuates the acoustical noise to a point wherein the decaying metallic "ring" is inaudible and yet the performance of the key switch 10 as perceived by an operator remains the same. The diameter of the cylindrical coil 26 is slightly larger than the diameter of the opening 25 to insure an interference fit between the spring 18 and the core 26 as shown in FIG. 4. The length of the cylindrical core 26 is substantially equal to the diameter of the core. For example, in one implementation of the invention the diameter of the opening 25 of the spring 18 was 0.086", the cylindrical core 26 had a diameter of 0.130" and a length of 0.125".

What is claimed is:

1. In a key switch acutating mechanism comprising:

a key top;

a housing having means for slidably receiving said key top for vertical motion thereof;

a pivoting rocker means located in said housing opposite said key top;

a buckling compression spring including coils forming a cylindrical opening, said spring mounted between said key top and said pivoting rocker means, the spring buckling and unbuckling in response to the downward and upward motion of the key top, respectively, the spring generating acoustical energy by the buckling and unbuckling action of the spring which energy manifests itself in at least two distinct types of sounds—metallic click and metallic ringing; and means for damping acoustical energy generated by the spring which manifests itself by the sound of metallic ringing.

2. Apparatus as described in claim 1 wherein said damping means comprises a cylindrical core of resilient material positioned within the opening formed by the coils of the buckling spring.

3. Apparatus as described in claim 2 wherein said cylindrical core is made of a closed cell urethane foam material.

4. Apparatus as described in claim 3 wherein the diameter of said cylindrical core is larger than the diameter of the opening formed by the coils of the spring.

5. Apparatus as described in claim 4 wherein the length of said cylindrical core is substantially equal to its diameter.

6. Apparatus as described in claim 5 wherein one end of said cylindrical core is positioned near said pivoting rocker means.

* * * * *